United States Patent [19]

Imatomi et al.

[11] 4,346,167

[45] Aug. 24, 1982

[54] SILVER HALIDE PHOTOGRAPHIC LIGHT-SENSITIVE MATERIAL AND PROCESS FOR PRODUCING SILVER HALIDE PHOTOGRAPHIC EMULSION

[75] Inventors: Eiji Imatomi; Tsuyoshi Ogawa; Tsutomu Hamaoka, all of Minami-ashigara, Japan

[73] Assignee: Fuji Photo Film Co., Ltd., Kanagawa, Japan

[21] Appl. No.: 287,850

[22] Filed: Jul. 29, 1981

[30] Foreign Application Priority Data

Jul. 29, 1980 [JP] Japan ..... 55-104207

[51] Int. Cl.[3] ..... G03C 1/02; G03C 1/28; G03C 1/34

[52] U.S. Cl. ..... 430/569; 430/599; 430/600; 430/605; 430/607; 430/608; 430/613; 430/949

[58] Field of Search ..... 430/605, 608, 569, 264, 430/949, 600, 615, 372, 607, 599, 566, 564, 567, 568, 613

[56] References Cited

U.S. PATENT DOCUMENTS

| | | | |
|---|---|---|---|
| 3,440,049 | 4/1969 | Moede | 430/566 |
| 3,488,709 | 1/1970 | Sidebotham | 430/564 |
| 3,672,902 | 6/1972 | van Stappen et al. | 430/566 |
| 3,901,713 | 8/1975 | Yamasue et al. | 430/564 |
| 4,221,864 | 9/1980 | Iytaka et al. | 430/567 |
| 4,233,400 | 11/1980 | Fujiwhara et al. | 430/567 |
| 4,268,621 | 5/1981 | Ogi | 430/607 |
| 4,283,479 | 8/1981 | Hamaoka et al. | 430/566 |
| 4,299,909 | 10/1981 | Imatomi et al. | 430/566 |

*Primary Examiner*—Mary F. Downey
*Attorney, Agent, or Firm*—Sughrue, Mion, Zinn, Macpeak & Seas

[57] ABSTRACT

A silver halide photographic light-sensitive material is described comprising a support having thereon at least one light-sensitive silver halide emulsion layer, said silver halide emulsion layer containing a rhodium salt in an amount sufficient to increase a contrast thereof, and said silver halide emulsion layer or a layer adjacent thereto containing a compound represented by the following formula (I) or (II), and a process for producing a silver halide photographic emulsion containing rhodium salts is also described which comprises adding a rhodium salt into a silver halide photographic emulsion in an amount sufficient to increase a contrast before the conclusion of first ripening and adding a compound represented by the following formula (I) or (II) into the resulting emulsion after washing to remove useless salts

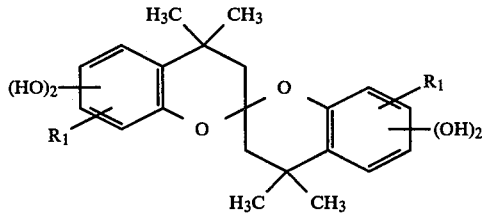

(I)

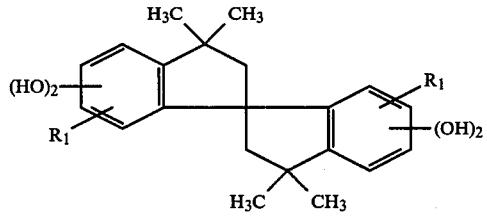

(II)

wherein $R_1$ represents hydrogen or a substituted or unsubstituted alkyl group.

The silver halide photographic light-sensitive material and a silver halide photographic emulsion each is capable of providing high contrast images and stabilized photographic properties; particularly, gradation properties remain stable during storage.

19 Claims, No Drawings

SILVER HALIDE PHOTOGRAPHIC LIGHT-SENSITIVE MATERIAL AND PROCESS FOR PRODUCING SILVER HALIDE PHOTOGRAPHIC EMULSION

FIELD OF THE INVENTION

The present invention relates to a silver halide photographic light-sensitive material and to a process for producing silver halide photographic emulsion and, more particularly, to a silver halide photographic light-sensitive material which is capable of providing a high contrast image by the addition of a rhodium salt and good storage stability, and to a process for producing silver halide photographic emulsion which is capable of providing a high contrast image and good storage stability.

BACKGROUND OF THE INVENTION

It is known that a rhodium salt can be added during the formation of grains of silver halide in order to increase a contrast of a silver halide emulsion. Rhodium salts are very useful in producing silver halide photographic emulsions, because the gradation of the photographic emulsions can be controlled by varying the amount of rhodium salt added.

High contrast silver halide photographic emulsions prepared by the addition of a rhodium salt have a remarkably low sensitivity as compared with emulsions not using a rhodium salt. Also, they have serious defects in that the properties of the resultant emulsions are not stable, and they can become sensitized during storage to change to a low contrast material. For the purpose of overcoming these defects, a process has been known which comprises adding a cadmium salt during production of silver halide photographic emulsions containing a rhodium salt, as described, for example, in U.S. Pat. No. 3,488,709. However, it is not preferred to use light-sensitive materials containing a cadmium salt, because the cadmium salt leaches into processing solutions used for development and fixing, and into a water used for washing, during photographic processing, to cause problems such as harmful influences upon humans and environmental pollution.

Furthermore, a process is known which comprises adding a water-soluble rhodium salt and a nucleic acid decomposition product before the conclusion of the first ripening of a silver halide photographic emulsion, as described in Japanese Patent Application (OPI) No. 23618/75 (the term "OPI" as used herein refers to a "published unexamined Japanese patent application"). The addition of a nucleic acid decomposition product to silver halide photographic emulsions is a well known technique, which provides a ripening controlling function, i.e., when the nucleic acid decomposition product is added before the conclusion of the first ripening (physical ripening), the growth of silver halide grains is controlled to result in the formation of finely divided particles or a change in crystal habit, which necessarily leads to a large change in photographic characteristics. Moreover, a nucleic acid decomposition product added before the conclusion of the first ripening remains in the emulsion after water washing, and influences the formation and growth of sensitive nuclei, causing a deterioration in sensitivity during the second ripening (chemical ripening).

SUMMARY OF THE INVENTION

Therefore, one object of the present invention is to provide a silver halide photographic light-sensitive material which is capable of providing high contrast images, and the gradation properties of which do not change during storage.

Another object of the present invention is to provide a process for producing a silver halide photographic emulsion which is capable of providing high contrast images, and the photographic properties, particularly gradation of which, are maintained stably during storage.

A further object of the present invention is to provide a silver halide photographic light-sensitive material using a high contrast silver halide photographic emulsion which has good storage stability without any adverse influences on other photographic properties, and which does not cause environmental pollution.

Other objects of the present invention will become apparent from the following detailed description and examples.

These objects of the present invention are attained by a silver halide photographic light-sensitive material comprising a support having thereon at least one silver halide light-sensitive emulsion layer, said silver halide emulsion layer containing a rhodium salt in an amount sufficient to provide high contrast, and said silver halide emulsion layer or a layer adjacent thereto containing a compound represented by formula (I) or (II) and by a process for producing a silver halide photographic emulsion containing rhodium salts which comprises adding a rhodium salt into a silver halide photographic emulsion in an amount sufficient to increase a contrast before the conclusion of first ripening and adding a compound represented by formula (I) or (II) into the resulting emulsion after washing to remove useless salt

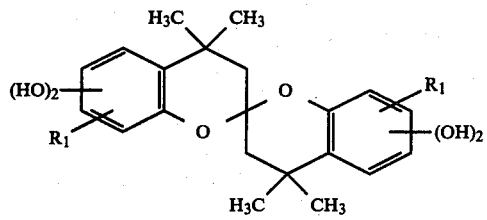

(I)

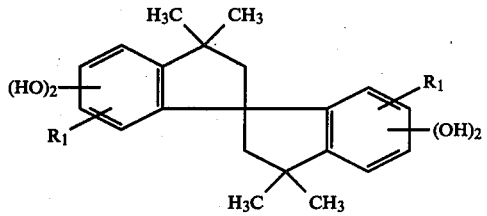

(II)

wherein $R_1$ represents hydrogen or a substituted or unsubstituted aklyl group.

DETAILED DESCRIPTION OF THE INVENTION

In the present invention, the rhodium salt can be added to the silver halide emulsion at any stage before the conclusion of the first ripening of the silver halide emulsion.

The rhodium salt that can be used in the present invention includes not only a simple salt but also a complex salt; known compounds as described in *Photographic Chemistry,* edited by P. Glafkides, page 318 and U.S. Pat. No. 2,448,060 are generally used. Typical examples of the rhodium salts include rhodium chloride, rhodium trichloride and rhodium ammonium chloride. Although the rhodium salt is necessarily added before the conclusion of first ripening, it is particularly preferred to add it during formation of the silver halide grains. The amount of the rhodium salt used can be varied depending on the desired gradation. However, it is particularly preferred to add the rhodium salt in a range of from $10^{-9}$ to $10^{-6}$ mol per mol of silver.

Now, the compound represented by formula (I) or (II) will be explained in greater detail below.

In the formulae (I) and (II), preferred examples of the alkyl group represented by $R_1$ include a methyl group, an ethyl group, a propyl group, a butyl group, a heptyl group, a hexyl group, a nonyl group, a decyl group, etc. The above-described alkyl group may be a straight chain alkyl group or a branched chain alkyl group. The substituents of the alkyl group described above include a halogen atom (for example, a chlorine atom, a bromine atom, etc.), a hydroxy group, a carboxy group, an alkoxy group (preferably an alkoxy group having from 1 to 4 carbon atoms) or a primary, secondary or tertiary amino group, etc. Of the alkyl groups, a substituted or unsubstituted alkyl group having 1 to 5 carbon atoms is particularly preferred since these are excellent in respect of solubility and photographic properties. The compound represented by formula (I) or (III) is particularly preferred when $R_1$ represents hydrogen or an unsubstituted alkyl group having 1 to 5 carbon atoms.

Specific examples of the compounds represented by formulae (I) and (II) according to the present invention are set forth below, but the present invention is not to be construed as being limited to use of these compounds.

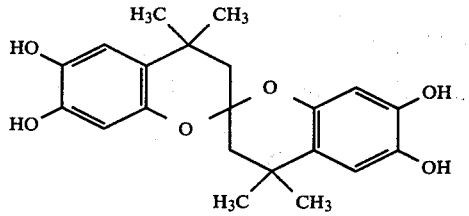
(I-1)

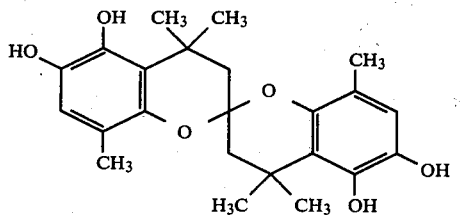
(I-2)

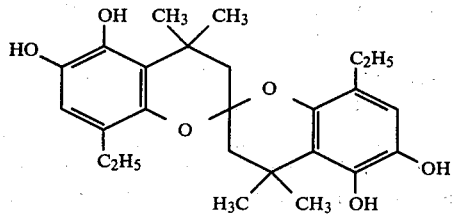
(I-3)

-continued

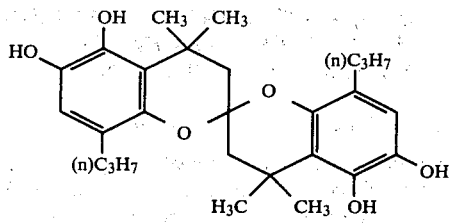
(I-4)

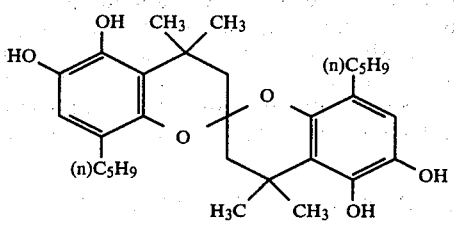
(I-5)

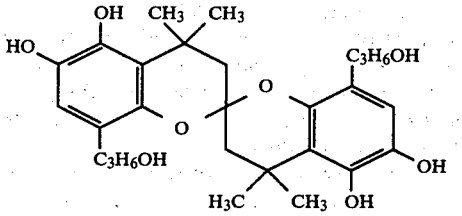
(I-6)

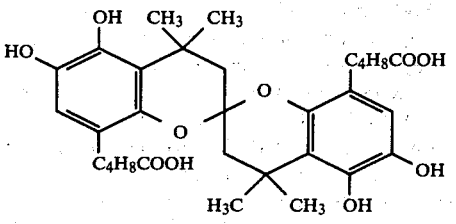
(I-7)

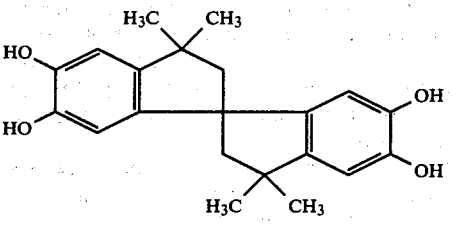
(II-1)

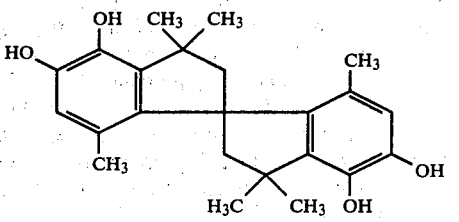
(II-2)

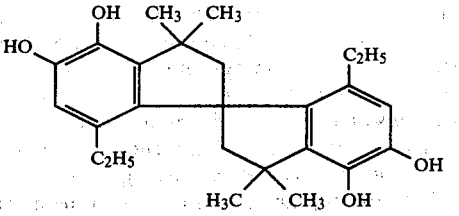
(II-3)

-continued (II-4)

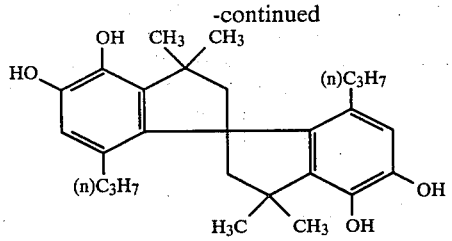

(II-5)

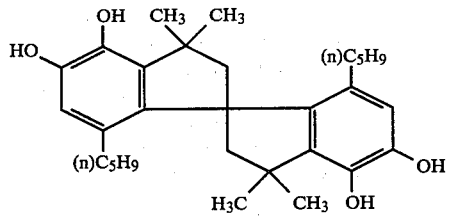

(II-6)

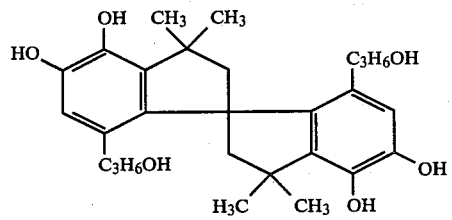

(II-7)

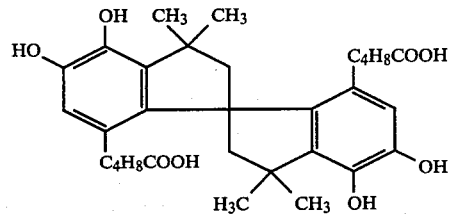

The compound represented by the formula (I) can be easily synthesized by methods analogous to those used in synthesizing the polyhydroxy-spiro-bis-indane compounds described in U.S. Pat. No. 3,440,049 (1969). For the purpose of obtaining the polyhydroxy-spiro-bis-chromans in a high yield by suppressing the conversion of them into the polyhydroxy-spiro-bis-indanes, it is important to keep the reaction temperature as low as possible, preferably at temperatures lower than about 100° C., and more preferably at lower than about 80° C.

The compounds represented by formula (II) can be synthesized by reference to the methods described in the *Journal of the Chemical Society,* pages 1678 to 1681 (1934) and U.S. Pat. No. 3,440,049.

The compound represented by formula (I) or (II) may be added to a silver halide emulsion layer or a layer adjacent thereto; for example, a surface protective layer, a subbing layer, or an intermediate layer.

When the compound represented by formula (I) or (II) is added to a silver halide emulsion layer, the compound can be added at any desired time after washing to remove useless salts in the preparation of a silver halide emulsion, such as during the second ripening (chemical ripening), after the conclusion of the second ripening, or before coating.

The amount of the compound represented by formula (I) or (II) to be added may be varied depending on the amount of the rhodium salt used. However, an amount in the range of from $10^{-5}$ to 1.0 mol per mol of silver is effective, and an amount in the range of $10^{-4}$ to $10^{-1}$ mol per mol of silver is particularly effective. In the above-described ranges, these compounds can be disregarded with respect to their influence upon photographic properties such as sensitivity, gradation, fog, etc.

The silver halide emulsion having high contrast according to the present invention is stable when allowed to stand under normal storage conditions or under more severe conditions.

Although the average grain size of the silver halide grains in the photographic emulsions (i.e., the average diameter of the grains where the grains are spherical or substantially spherical, or the average side length where the grains are cubic, determined by the average projection area) are not limited to any special certain range, but less than 3μ is preferred. The grain size distribution size may be either broad or narrow. The silver halide grains may be composed of different phases, wherein the core thereof is different from the shell, or may be homogeneous. Further, the grains may be those wherein latent images are formed mainly on the surface thereof (surface latent image type silver halide grain), or may be those wherein latent images are formed mainly in the interior thereof (interior latent image type silver halide grain).

In the present invention, a silver halide emulsion having surface latent image type silver halide grains is more useful.

The photographic emulsions of the present invention can be prepared by processes as are generally described in *Chimie et Physique Photographique,* by P. Glafkides (published by Paul Montel Co., 1967), *Photographic Emulsion Chemistry,* by G. F. Duffin (published by The Focal Press, 1966) and *Making and Coating Photographic Emulsions,* by V. L. Zelikman et al. (published by The Focal Press, 1964), etc. It is possible to use any of an acid process, a neutral process, or an ammonia process. It is further possible to use a process which comprises reacting a soluble silver salt with a soluble halogen salt, such as single-jet mixing process, a double-jet mixing process, or a combination thereof. A process for forming grains in the presence of excess silver ions (i.e., the so-called reverse mixing process) may also be used. One type of simultaneous mixing process comprises maintaining a definite pAg value of the liquid phase wherein the silver halide is formed (i.e., the so-called controlled double-jet process). By this process, silver halide emulsions having a regular crystal form and a substantially uniform particle size can be produced.

Two or more silver halide emulsions produced separately may be mixed, if desired.

As binders or protective colloids for the photographic emulsions, although gelatin is usually used, other hydrophilic colloids can be used. For example, colloids that can be used include gelatin derivatives, graft polymers of gelatin and another polymeric material, and proteins such as albumin or casein; cellulose derivatives, such as hydroxyethyl cellulose or carboxymethyl cellulose, etc.; sugar derivatives, such as agar, sodium alginate or starch derivatives; and synthetic hydrophilic polymeric materials, such as homopolymers or copolymers, such as the partial acetal of polyvinyl alcohol, poly-N-vinylpyrrolidone, polyacrylic acid, polyacrylamide, polyvinylimidazole, polyvinylpyrazole, etc.

As the gelatin, not only lime-processed gelatin, but also acid-processed gelatin may be used. Further, gelatin hydrolysis products and gelatin enzymatic decomposition products can also be used.

For chemical sensitization of the silver halide emulsion, processes as described in *Die Grundlagen der Photographischen Prozesse mit Silber Halogeniden,* edited by H. Frieser, (Akademische Verlagsgesellschaft, 1968) and other known processes can be used.

For example, it is possible to use a sulfur sensitization process using sulfur-containing compounds which are reactive with silver ions or active gelatin, a reduction sensitization process using reducing materials and a noble metal sensitization process using gold or other noble metal compounds, which may be used alone or as a combination thereof. Examples of sulfur sensitizing agents include thiocyanates, thioureas, thiazoles, rhodanines and the like, examples of which are described in U.S. Pat. Nos. 1,574,944, 2,410,689, 1,725,934, 2,278,947, 3,501,313, 2,728,668 and 3,656,955. Examples of reduction sensitizing agents include stannous salts, amines, hydrazine derivatives, formamidine sulfinic acid and silane compounds, which are described in U.S. Pat. Nos. 2,487,850, 2,419,974, 2,419,975, 2,518,698, 2,521,925, 2,521,926, 2,983,610 and 2,694,637. In order to carry out noble metal sensitization, not only gold complex salts but also complex salts of metals of Group VIII of the Periodic Table, such as platinum, iridium or palladium, etc., can be used, examples of which are described in British Pat. No. 570,393 and U.S. Pat. Nos. 2,399,083 and 2,448,060.

The photographic emulsions of the present invention may contain various conventional compounds for the purpose of preventing fogging (during a step of producing the light-sensitive material, during storage, or during photographic processing thereof) or to stabilize photographic properties. Particularly, compounds that can be used include azole and azine compounds such as benzothiazoles, amino-, nitro-, and halogen-substituted benzimidazoles, nitro- and amino-substituted indazoles, triazoles, unsubstituted benzotriazoles, nitro-, halogen-, and alkyl-substituted benzotriazoles, mercaptothiazoles, mercaptobenzothiazoles, mercaptobenzimidazoles, mercaptothiadiazoles, mercaptotriazoles, mercaptotetrazoles, mercaptopyrimidines and thioketo compounds such as thiazolethione, etc.; azaindenes, such as triazaindenes, tetraazaindenes, and pentaazaindenes; benzene sulfinic acid, benzene sulfinic acid amide, benzene thiosulfonic acid, thioctic acids, phenazines, iodoniums, iodates, polymers such as polyvinyl pyrrolidone, halogen-substituted dibasic aliphatic acids, noble metal salts (for example, compounds of gold, platinum, palladium or iridium, etc.) and heterocyclic ring-containing aminostilbene compounds, which may be used alone or as a combination of two or more thereof. Examples of such compounds are described in U.S. Pat. Nos. 2,131,038, 2,271,229, 2,503,861, 2,403,927, 2,453,087, 2,432,864, 3,051,570 and 2,824,001, British Pat. Nos. 403,789 and 452,043, Japanese Patent Publication No. 17377/60, U.S. Pat. Nos. 2,444,605, 2,444,606, 2,450,397, 2,933,388 and 2,713,541, Japanese Patent Publication Nos. 5647/59 and 17378/60, U.S. Pat. Nos. 2,057,764, 2,394,198, 2,948,614, 3,128,186 and 3,128,187, British Pat. No. 851,774, German Pat. Nos. 1,107,508 and 645,053, Belgian Pat. No. 575,907, Japanese Patent Publication Nos. 4136/68 and 4134/68, and U.S. Pat. Nos. 2,282,005, 2,675,314, 2,472,631, 2,552,229, 2,552,230, 2,566,245, 2,566,263 and 2,597,856.

For the purpose of preventing fogging or desensitization due to metal ions, various kinds of chelating agents, such as dihydroxybenzoic acid, gallic acid, dimethylglyoxime or ethylenediaminetetraacetic acid, etc., may be added to the emulsions. Examples of such compounds are disclosed in U.S. Pat. No. 2,691,588, British Pat Nos. 623,448 and 952,162, Japanese Patent Publication Nos. 4133/68 and 4941/68 and U.S. Pat. No. 3,457,079.

The photographic emulsions of the present invention may be spectrally sensitized by methine dyes or the like. Examples of the dyes used include cyanine dyes, merocyanine dyes, complex cyanine dyes, complex merocyanine dyes, holopolar cyanine dyes, hemicyanine dyes, styryl dyes, and hemioxonol dyes. Particularly preferred dyes are cyanine dyes, merocyanine dyes and complex merocyanine dyes. As basic heterocyclic nuclei constituting the molecule of these dyes, any nucleus may be utilized that is conventionally utilized in cyanine dyes.

It is advantage in spectrally sensitizing the photographic emulsion prepared according to the manner of the present invention to use a sensitizing dye as described in Japanese Patent Application (OPI) Nos. 134315/74, 23220/75 and 33828/75.

The photographic emulsions of the present invention may contain inorganic or organic hardening agents, if desired. Examples of inorganic hardening agents include chromium salts such as chromium alum, or chromium acetate, etc., and zirconium salts. Examples of organic hardening agents include aldehydes such as formaldehyde, glyoxal or glutaraldehyde, etc., N-methylol compounds such as N,N'-dimethylolurea or methylol dimethylhydantoin, etc., dioxane derivatives such as 2,3-dihydroxydioxane, epoxy group-containing compounds such as 1,4-butylene-bis-2,3-epoxypropyl ether, etc., ethyleneimine compounds such as 2,4,6-triethyleneimino-s-triazine or hexamethylene-N,N'-bisethyleneurea, etc., active vinyl compounds such as 1,3,5-triacryloylhexahydro-s-triazine, divinyl ketone, dininyl sulfone or methylenebismaleimide, etc., active halogen-containing compounds such as 2,4-dichloro-6-hydroxy-s-triazine, etc., mucohalic acids such as mucochloric acid, mucobromic acid or mucophenoxychloric acid, etc., bismethanesulfonic acid esters such as 1,2-di(methanesulfonyloxy)ethane, etc., sulfonyl compounds such as bisbenzenesulfonyl chloride, etc., carbodiimides such as n-propyl allylcarbodiimide, etc., isocyanates, isoxazoles and polymeric hardening agents such as dialdehyde starch or 2-chloro-6-hydroxy-s-triazinyl gelatin, etc. These hardening agents may be used alone or as a combination of two or more thereof. Precursors of hardening agents such as an aldehyde-sulfite addition products may also be used.

Various known surface active agents may be added to the photographic emulsions of the present invention as coating aids or for the purpose of preventing electrostatic charging or improving lubricating properties and the like. For example, it is possible to use nonionic surface active agents, such as saponin, polyethylene glycol, polyethylene glycol-polypropylene glycol condensation products, polyalkylene glycol ethers, polyalkylene glycol esters or polyalkylene glycol amides, etc., and anionic surface active agents such as alkylcarboxylic acid salts, alkylsulfonic acid salts, alkylbenzenesulfonates, alkylnaphthalenesulfonates, alkylsulfates, N-acyl-N-alkyltaurines, maleopimaric acid salts and the like.

It is also possible to use amphoteric surface active agents such as those described in British Pat. No. 1,159,825, Japanese Patent Publication No. 378/65, Japanese Patent Application (OPI) No. 43924/73 and U.S. Pat. No. 3,726,683. It is further possible to use fluorine-containing surface active compounds as described in U.S. Pat. Nos. 3,589,906, 3,666,478, and 3,754,924, German Patent Publication No. 1,961,638 and Japanese Patent Application (OPI) No. 59025/75.

The photographic emulsions of the present invention may also contain a dispersion of a water-insoluble or substantially water-insoluble synthetic polymer for the purpose of improving dimensional stability. For example, it is possible to use polymers composed of one or more monomers selected from alkyl acrylates or methacrylates, alkoxyalkyl acrylates or methacrylates, glycidyl acrylates or methacrylates, acrylamide or methacrylamide, vinyl esters (for example, vinyl acetate), acrylonitrile, olefins and styrene or polymers composed of a combination of such monomers and acrylic acid, methacrylic acid, $\alpha,\beta$-unsaturated dicarboxylic acids.

Examples of supports which can be used in the silver halide photographic light-sensitive material of the present invention include a cellulose ester film such as a cellulose triacetate film, a polyester film such as a polyethylene terephthalate film, paper, paper coated with an $\alpha$-olefin such as polyethylene, etc.

The silver halide photographic light-sensitive material of the present invention comprises a support having thereon at least one silver halide emulsion layer, and, in addition, a subbing layer, a surface protective layer, a filter layer, etc., if desired.

It is preferred to contain fine particles of silicon oxide or polymethyl methacrylate as a matting agent in the surface protective layer.

Light exposure applied to the photographic light-sensitive material of the present invention is not particularly restricted. Light exposure time may range from a long time such as several seconds to a short time such as 1/20 to 1/100,000 second. Furthermore, xenon light and laser light can also be used for such exposure.

There are no special limitations as to process that can be used for photographic processing of the silver halide photographic light-sensitive material of the present invention; i.e., any known process and any known processing solution can be used for processing. The processing temperature is usually 18° C. to 50° C., but it may be lower than 18° C. or above 50° C.

Both development for forming silver images (black-and-white photographic processing) and color photographic development for forming color images may be applied to the photographic emulsions of the present invention, according to the particular purpose.

The developing solutions used for the black-and-white photographic processing can contain known developing agents. Examples of such developing agents include dihydroxybenzenes (for example, hydroquinone, chlorohydroquinone or methylhydroquinone, etc.), 3-pyrazolidones (for example, 1-phenyl-3-pyrazolidone, or 1-phenyl-4-methyl-3-pyrazolidone, etc.), aminophenols (for example, o-aminophenol, p-aminophenol, N-methyl-p-aminophenol or 2,4-diaminophenol, etc.), pyrogallol, ascorbic acid and 1-aryl-3-pyrazolines (for example, 1-(p-hydroxyphenyl)-3-aminopyrazoline or 1-(p-methylaminophenyl)-3-aminopyrazoline, etc.), which may be used alone or as a combination of two or more thereof.

The developing solutions may contain, if desired or necessary, various conventional additives, for example, preservatives (for example, sulfites, bisulfites or ascorbic acid, etc.), alkali agents (hydroxides or carbonates, etc.), pH buffer agents (for example, carbonates, borates, boric acid, acetic acid, citric acid or alkanolamines, etc.), auxiliary solubilizing agents (for example, polyethylene glycols and esters thereof, or alkanolamines, etc.), sensitizing agents (for example, nonionic surface active agents containing a polyoxyethylene chain or quaternary ammonium compounds, etc.), surface active agents, antifogging agents (for example, halides such as potassium bromide or sodium bromide, etc., nitroindazole, nitrobenzimidazole, benzotriazole, benzothiazole, tetrazoles and thiazoles, etc.), chelating agents (for example, ethylenediaminetetraacetic acid or alkali metal salts thereof, nitrilotriacetate or polyphosphates, etc.), development accelerators (for example, compounds as described in U.S. Pat. No. 2,304,025 and Japanese Patent Publication No. 45541/72), hardening agents (for example, glutaraldehyde) or defoaming agents.

So-called "lithotype" development can be applied to the photosensitive materials of the present invention, if desired. "Lithotype" development refers to a development processing which comprises carrying out an infectious development using dihydroxybenzenes as developing agents under a low sulfite ion concentration in order to photographically reproduce line images or photographically reproduce halftone images by means of a halftone screen (described in *Photographic Processing Chemistry,* by L. F. A. Mason, pages 163–165 (1966)).

In the following, the present invention is illustrated in greater detail by reference to several examples.

EXAMPLE 1

A silver iodobromide emulsion (silver iodide:1 mol%) was prepared by a double-jet process as described below.

An aqueous solution of potassium bromide and potassium iodide containing rhodium trichloride in an amount of $10^{-7}$ mol/mol of silver and an aqueous solution of silver nitrate were continuously added to an aqueous solution of gelatin at 63° C. while stirring to form silver iodobromide particles. After water washing, the emulsion was sulfur and gold sensitized using sodium thiosulfate 6.4 mg/mol-Ag and potassium chloroaurate 6.4 mg/mol-Ag in a conventional manner. After adding 2-methyl-4-hydroxy-1,3,3a,7-tetraazaindene as a stabilizer thereto, the emulsion was divided into two portions. To one portion, the above-described Compound I-1 was added in an amount of $1\times10^{-2}$ mol per mol of silver. On the other hand, the compound was not added to the other portion. The resulting emulsions were then each coated onto a paper coated with polyethylene and dried.

The resulting samples were stepwise exposed to light in a conventional manner and developed at 20° C. for 60 seconds using a D-72 developer (the composition thereof being indicated by Eastman Kodak Co., Ltd.).

Samples exposed and developed just after coating and samples which were subjected to aging under conditions of a temperature of 50° C. and a relative humidity of 65% for 3 days before exposure and developing were examined.

For purposes of comparison, the same examination was carried out on samples prepared using the emulsion prepared without using the rhodium salt.

The results obtained are shown in Table 1.

TABLE 1

| | Rhodium Salt | Compound I-1 | Contrast just after Coating | Contrast after Aging | Variation of Sensitivity (Δ log E) D = 1.0 |
|---|---|---|---|---|---|
| (1) (Control) | None | None | 1.04 | 1.03 | +0.02 |
| (2) (Comparison) | None | Present | 1.03 | 1.02 | +0.02 |
| (3) (Comparison) | Present | None | 2.52 | 2.04 | +0.21 |
| (4) (Present Invention) | Present | Present | 2.53 | 2.50 | +0.04 |

It is apparent from the results shown in Table 1 above that by the use of rhodium salt and Compound I-1 according to the present invention in combination, the contrast does not decrease even being subjected to aging prior to exposure and development, and the variation of sensitivity after aging is very small and stable.

EXAMPLE 2

To an emulsion as used in Example 1, 2-methyl-4-hydroxy-1,3,3a,7-tetraazaindene was added as a stabilizer, and the emulsion with stabilizer was coated as an emulsion layer. Further, a gelatin protective layer was coated adjacent to the emulsion layer. To a gelatin protective layer of one sample, the above-described Compound I-1 was added in an amount of $1\times10^{-2}$ mol per mol of silver. The above-described Compound II-1 was added in an amount of $1\times10^{-2}$ mol per mol of silver to a gelatin protective layer of another sample. On the other hand, the compound was not added to a gelatin protective layer of the rest. These layers were coated on a paper coated with polyethylene.

The resultant samples were examined in the same manner as in Example 1 and the results obtained are shown in Table 2.

TABLE 2

| | Rhodium Salt | Compound Added | Contrast just after Coating | Contrast after Aging | Variation of Sensitivity (Δ log E) D = 1.0 |
|---|---|---|---|---|---|
| (5) (Control) | None | None | 1.07 | 1.06 | +0.01 |
| (6) (Comparison) | None | Compound I-1 | 1.04 | 1.03 | +0.01 |
| (7) (Comparison) | Present | None | 2.56 | 1.98 | +0.23 |
| (8) (Present Invention) | Present | Compound I-1 | 2.54 | 2.50 | +0.03 |
| (9) (Present Invention) | Present | Compound II-1 | 2.54 | 2.50 | +0.03 |

It is apparent from the results shown in Table 2 above that by the use of rhodium salt and Compound I-1 or Compound II-1 according to the present invention in combination, the contrast does not decrease even after being subjected to aging prior to exposure and development, and the variation of sensitivity after aging is very small and stable.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having thereon at least one light-sensitive silver halide emulsion layer, said silver halide emulsion layer containing a rhodium salt in an amount sufficient to increase a contrast thereof, and said silver halide emulsion layer or a layer adjacent thereto containing a compound represented by formula (I) or (II)

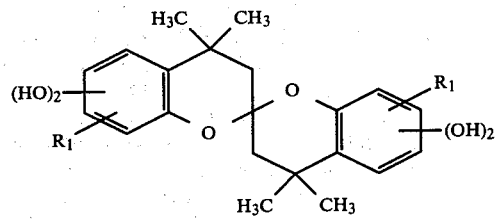

(I)

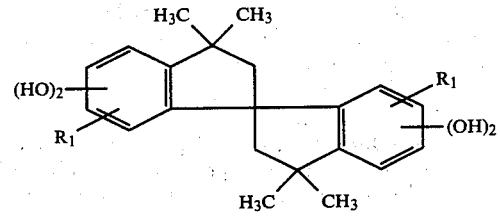

(II)

wherein $R_1$ represents hydrogen or a substituted or unsubstituted alkyl group.

2. A silver halide photographic light-sensitive material as in claim 1, wherein said compound contained in said silver halide emulsion layer or a layer adjacent thereto is a compound according to formula (I).

3. A silver halide photographic light-sensitive material as in claim 1, wherein said compound contained in said silver halide emulsion layer or a layer adjacent thereto is a compound according to formula (II).

4. A silver halide photographic light-sensitive material as in claim 1, 2, or 3, wherein the rhodium salt is rhodium chloride, rhodium trichloride, or rhodium ammonium chloride.

5. A silver halide photographic light-sensitive material as in claim 1, 2, or 3, wherein the amount of the rhodium salt used is in the range of from $10^{-9}$ to $10^{-6}$ mol per mol of silver.

6. A silver halide photographic light-sensitive material as in claim 1, 2, or 3, wherein $R_1$ represents an alkyl group substituted with one or more substituents selected from a halogen atom, a hydroxy group, a carboxy group, an alkoxy group, and a primary, secondary, or tertiary amino group.

7. A silver halide photographic light-sensitive material as in claim 1, 2, or 3, wherein $R_1$ represents a substituted or unsubstituted alkyl group having from 1 to 5 carbon atoms.

8. A silver halide photographic light-sensitive material as in claim 1, 2, or 3, wherein the compound represented by formula (I) or (II) is present in the silver halide emulsion layer containing the rhodium salt.

9. A silver halide photographic light-sensitive material as in claim 1, 2, or 3, wherein the compound represented by formula (I) or (II) is present in a layer adjacent to the silver halide emulsion layer containing the rhodium salt.

10. A silver halide photographic light-sensitive material as in claim 9, wherein the layer adjacent to the silver halide emulsion layer is a surface protective layer, a subbing layer, or an intermediate layer.

11. A silver halide photographic light-sensitive material as in claim 1, 2, or 3, wherein the amount of compound represented by formula (I) or (II) is in the range of from $10^{-5}$ to 1.0 mol per mol of silver.

12. A silver halide photographic light-sensitive material as in claim 1, 2, or 3, wherein the amount of compound represented by formula (I) or (II) is in the range of from $10^{-4}$ to $10^{-1}$ mol per mol of silver.

13. A process for producing a silver halide photographic emulsion containing rhodium salts which comprises adding a rhodium salt into a silver halide photographic emulsion in an amount sufficient to increase a contrast before the conclusion of first ripening and adding a compound represented by formula (I) or (II) into the resulting emulsion after washing to remove useless salts

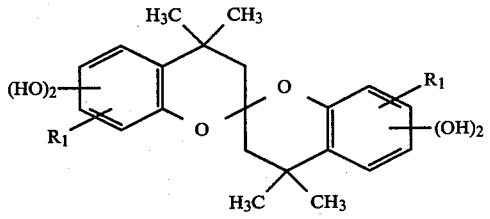

(I)

-continued

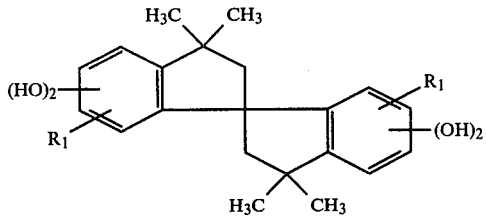

(II)

wherein $R_1$ represents hydrogen or a substituted or unsubstituted alkyl group.

14. A process for producing a silver halide photographic emulsion as in claim 13, wherein the rhodium salt is rhodium chloride, rhodium trichloride, or rhodium ammonium chloride.

15. A process for producing a silver halide photographic emulsion as in claim 13, wherein the amount of the rhodium salt used is in the range of from $10^{-9}$ to $10^{-6}$ mol per mol of silver.

16. A process for producing a silver halide photographic emulsion as in claim 13, wherein $R_1$ represents an alkyl group substituted with one or more substituents selected from a halogen atom, a hydroxy group, a carboxy group, an alkoxy group, and a primary, secondary, or tertiary amino group.

17. A process for producing a silver halide photographic emulsion as in claim 13, wherein $R_1$ represents a substituted or unsubstituted alkyl group having from 1 to 5 carbon atoms.

18. A process for producing a silver halide photographic emulsion as in claim 13, wherein the amount of compound represented by formula (I) or (II) is in the range of from $10^{-5}$ to 1.0 mol per mol of silver.

19. A process for producing a silver halide photographic emulsion as in claim 13, wherein the amount of compound represented by formula (I) or (II) is in the range of from $10^{-4}$ to $10^{-1}$ mol per mol of silver.

* * * * *